US008593374B2

(12) United States Patent
Kato et al.

(10) Patent No.: US 8,593,374 B2
(45) Date of Patent: Nov. 26, 2013

(54) OUTPUT DEVICE AND WEARABLE DISPLAY

(75) Inventors: Shigeru Kato, Kawasaki (JP); Kazuou Isagi, Saitama (JP); Masaki Otsuki, Yokohama (JP); Kenzo Chiaki, Kawasaki (JP)

(73) Assignee: Nikon Corporation, Tokyo (JP)

( * ) Notice: Subject to any disclaimer, the term of this patent is extended or adjusted under 35 U.S.C. 154(b) by 1238 days.

(21) Appl. No.: 12/309,976

(22) PCT Filed: Sep. 13, 2007

(86) PCT No.: PCT/JP2007/067834

§ 371 (c)(1),
(2), (4) Date: Feb. 5, 2009

(87) PCT Pub. No.: WO2008/035612

PCT Pub. Date: Mar. 27, 2008

(65) Prior Publication Data

US 2009/0195479 A1 Aug. 6, 2009

(30) Foreign Application Priority Data

Sep. 19, 2006 (JP) ..... 2006-252224
Dec. 11, 2006 (JP) ..... 2006-333235
Dec. 12, 2006 (JP) ..... 2006-334230
Dec. 12, 2006 (JP) ..... 2006-334237

(51) Int. Cl.
*G09G 5/00* (2006.01)

(52) U.S. Cl.
USPC ..... 345/8; 345/7; 345/9

(58) Field of Classification Search
USPC ..... 345/7–9
See application file for complete search history.

(56) References Cited

U.S. PATENT DOCUMENTS 4,952,024 A * 8/1990 Gale ..... 359/477
4,977,456 A * 12/1990 Furuya ..... 348/333.01
5,153,569 A * 10/1992 Kawamura et al. ..... 345/8
5,162,828 A * 11/1992 Furness et al. ..... 353/122
5,281,957 A * 1/1994 Schoolman ..... 345/8
5,321,416 A * 6/1994 Bassett et al. ..... 345/8
5,671,037 A 9/1997 Ogasawara et al.

(Continued)

FOREIGN PATENT DOCUMENTS

JP A-06-141308 5/1994
JP A-08-086974 4/1996

(Continued)

*Primary Examiner* — Amare Mengistu
*Assistant Examiner* — Sarvesh J Nadkarni
(74) *Attorney, Agent, or Firm* — Oliff & Berridge, PLC

(57) ABSTRACT

A headphone includes a pad which is brought into contact with a human head, an enclosure which outputs an audio, and a dome as means for adjusting quality of the audio output by resonating or absorbing the sound wave emitted from the enclosure. The dome has no parts other than those used for absorbing and reflecting audio and is almost hollow. In the dome is arranged a circuit substrate by using a circuit support part having a shape not blocking the air flowing in the dome. Such a circuit substrate is also built in the other headphone. The circuit substrates arranged in the dome of the headphone are connected by a cable arranged inside a head band or an FPC for transmission of a signal and power supply. Thus, it is possible to provide an output device which can solve the problem of the dimensions for containing operation processing devices and the problem of heat dissipation.

8 Claims, 6 Drawing Sheets

(56) References Cited

U.S. PATENT DOCUMENTS

| | | | | |
|---|---|---|---|---|
| 5,815,126 | A * | 9/1998 | Fan et al. | 345/8 |
| 5,971,538 | A * | 10/1999 | Heffner | 351/137 |
| 6,034,653 | A * | 3/2000 | Robertson et al. | 345/8 |
| 6,040,945 | A * | 3/2000 | Karasawa | 359/630 |
| D429,253 | S * | 8/2000 | Robertson et al. | D14/496 |
| D433,023 | S * | 10/2000 | Pinchuk | D14/372 |
| 6,172,657 | B1 * | 1/2001 | Kamakura et al. | 345/8 |
| 6,181,304 | B1 * | 1/2001 | Robinson et al. | 345/8 |
| 6,222,677 | B1 * | 4/2001 | Budd et al. | 359/630 |
| 6,234,446 | B1 * | 5/2001 | Patterson | 248/694 |
| 6,255,650 | B1 * | 7/2001 | Warner et al. | 250/330 |
| 6,304,287 | B1 * | 10/2001 | Nagata | 348/53 |
| 6,351,252 | B1 * | 2/2002 | Atsumi et al. | 345/8 |
| 6,359,602 | B1 * | 3/2002 | Amafuji et al. | 345/8 |
| 6,421,031 | B1 * | 7/2002 | Ronzani et al. | 345/8 |
| 6,424,321 | B1 * | 7/2002 | Ronzani et al. | 345/8 |
| 6,452,577 | B1 * | 9/2002 | Gale et al. | 345/87 |
| 6,480,174 | B1 * | 11/2002 | Kaufmann et al. | 345/8 |
| 6,496,161 | B1 * | 12/2002 | Tanaka | 345/8 |
| 6,560,029 | B1 * | 5/2003 | Dobbie et al. | 359/631 |
| 6,683,584 | B2 * | 1/2004 | Ronzani et al. | 345/8 |
| 6,803,885 | B1 * | 10/2004 | Guttag et al. | 345/8 |
| 6,879,443 | B2 * | 4/2005 | Spitzer et al. | 359/630 |
| 6,980,165 | B2 * | 12/2005 | Yuasa et al. | 343/718 |
| 7,031,068 | B2 * | 4/2006 | Himmele | 359/630 |
| 7,068,242 | B2 * | 6/2006 | Kiyokawa | 345/8 |
| 7,088,234 | B2 * | 8/2006 | Naito et al. | 340/539.11 |
| 7,124,425 | B1 * | 10/2006 | Anderson et al. | 725/68 |
| 7,155,025 | B1 * | 12/2006 | Weffer | 381/370 |
| 7,245,273 | B2 * | 7/2007 | Eberl et al. | 345/7 |
| 7,542,012 | B2 * | 6/2009 | Kato et al. | 345/8 |
| 2002/0149545 | A1 * | 10/2002 | Hanayama et al. | 345/7 |
| 2004/0032964 | A1 * | 2/2004 | Liang | 381/370 |
| 2006/0119539 | A1 * | 6/2006 | Kato et al. | 345/8 |
| 2007/0177239 | A1 * | 8/2007 | Tanijiri et al. | 359/13 |

FOREIGN PATENT DOCUMENTS

| | | |
|---|---|---|
| JP | A-11-008893 | 1/1999 |
| JP | A-2004-080679 | 3/2004 |
| JP | A-2004-233899 | 8/2004 |
| WO | WO 2004/061519 A1 | 7/2004 |

* cited by examiner

OUTPUT DEVICE AND WEARABLE DISPLAY

TECHNICAL FIELD

The present invention relates to an output device and a wearable display.

BACKGROUND ART

Recently there have been various glasses-type video display devices in which video displayed on a display device such as a Liquid Crystal Display (LCD) is observed as a virtual image enlarged through an optical system having an eyepiece, a half mirror, or the like. Such glasses-type video display devices are called a wearable display. For example, WO2004/061519A1 (Patent Document 1) discloses an example of a wearable display.

Many video display devices are configured in such a way that they are worn on a head while wrapped around the head (called wearable displays). Such video display devices are mainly divided into a binocular type in which the video display system is formed at positions corresponding to eyes and a monocular type in which the video display system is formed at a position corresponding to one of the right and left eyes. Usually such wearable displays include a display unit which displays video and a headphone which supplies sound. Sometimes such wearable displays supply only video.

Many wearable displays which are worn on the head to display video to an eye of a user simultaneously include an output device formed by right and left headphones. In such wearable displays, it is investigated that a processing unit and the like for performing video output control, audio output control, and power supply control associated therewith are accommodated in the headphones. In the case where the processing unit and the like are accommodated in the headphones, a method in which the processing unit and the like are collectively accommodated in a headphone for one of the ears is adopted from the viewpoint of electric wiring distribution.

Headphones are widely used as an audio output device for listening to music.

Patent Document 1: WO2004/061519A1

DISCLOSURE OF THE INVENTION

Problem to be Solved by the Invention

In such portable type wearable displays, there is increasingly adopted a method for compression-recording moving image and audio information and restoring the recorded information in viewing and listening to the information. Therefore, load of the processing unit and the like is increasing, which tends to enlarge dimensions of the processing unit and the like. With increasing load, there is generated a problem in that heat generated by the circuits cannot sufficiently be radiated.

In view of the foregoing, an object of the present invention is to provide an output device in which the problem of the accommodation dimensions of the processing unit and the like and the problem of radiation are solved, and a wearable display in which the output device is used.

There is also a demand for accommodating electric circuits in the headphones or the wearable display. In such cases, frequently electric circuits are accommodated in headphones or retaining units which retain speaker units of the wearable display. However, when all the electric circuits are accommodated in a retaining unit, unfortunately the dimensions of the retaining unit are enlarged, and unfortunately a temperature of the retaining unit is raised due to heat generated by the electric circuits.

Furthermore, in view of the foregoing, another object of the present invention is to provide an output device in which the dimensions of retaining units are restrained without generating the problem of heat generation.

Means for Solving the Problem

A first aspect in accordance with the present invention provides a wearable display includes two fixing units which are worn on a head; a coupling unit which couples the two fixing units; and a display unit which is connected to one of said fixing units or said coupling unit, wherein circuit boards are separately provided in two or more portions in said two fixing units or said coupling unit, and the separately provided circuit boards are disposed at functionally optimum positions.

A second aspect in accordance with the present invention provides the wearable display of the first aspect, wherein the separately provided circuit boards include a processing unit.

A third aspect in accordance with the present invention provides the wearable display of the first or second aspect, wherein said display unit is connected to one of said two fixing units, and a circuit associated with image display is provided in the fixing unit connected to said display unit.

A fourth aspect in accordance with the present invention provides the wearable display of the third aspect, wherein a rechargeable battery and a power supply control circuit are provided in the fixing unit which is not connected to said display unit.

A fifth aspect in accordance with the present invention provides the wearable display in one of the first to fourth aspects, wherein a wireless circuit is provided in said coupling unit.

A sixth aspect in accordance with the present invention provides an output device which has a pair of right and left headphones, a processing units and the like which control an audio output and other inputs and outputs being included in said headphones of the output device, wherein said processing units and the like are separately provided in two positions, and the separately provided processing units and the like are accommodated in the left-ear headphone and the right-ear headphone, respectively.

A seventh aspect in accordance with the present invention provides a wearable display characterized by including the output device of the sixth aspect.

An eighth aspect in accordance with the present invention provides an output device which is used while worn on a head, said output device supplying at least one of sound and video, the output device including: right and left fixing members which have a contact with head side surfaces; a head band unit which imparts a biasing force such that said fixing members are pressed against said right and left head side surfaces; retaining units which retain said fixing member; and headphone arm units which are integrated with said retaining units to couple said retaining units and said head band unit in such a way that the headphone arm units can be expanded and contracted, wherein electric circuits accommodated in the output device are separately provided in at least two portions in said retaining units and said headphone arm units.

A ninth aspect in accordance with the present invention provides the output device of the eighth aspect, wherein said headphone arm units are slid while inserted into said head band unit, thereby joining said retaining units and said head band unit in such a way that the headphone arm units can be expanded and contracted, and an electric circuit accommodated in one of said headphone arm units is accommodated at a position located inside the one of said headphone arm units even if the one of said headphone arm units is pulled out from said head band unit at a maximum.

A tenth aspect in accordance with the present invention provides the output device of the eighth or ninth aspect, wherein the electric circuit accommodated in said headphone arm units is a power supply circuit.

An eleventh aspect in accordance with the present invention provides the output device of the eighth or ninth aspect, wherein the electric circuit accommodated in said headphone arm units is a wireless communication circuit.

A twelfth aspect in accordance with the present invention provides the output device of the eleventh aspect, wherein said wireless communication circuit includes an antenna, and at least a position in said head band unit where said antenna is located is made of a material which transmits the radio wave.

A thirteenth aspect in accordance with the present invention provides a wearable display which is used while worn on a head, said wearable display supplying sound and video, the wearable display including: right and left ear pads which have a contact with head side surfaces; right and left retaining units which retain said ear pads, respectively; a head band unit which is coupled to said retaining units to impart a biasing force such that said ear pads are pressed against said right and left head side surfaces; a display unit arm which is coupled to one of said retaining units with a turning unit interposed therebetween; and a display unit which is coupled to a leading end portion of said display unit arm, an electric circuit being incorporated in the one of said retaining units coupled to said display unit arm, wherein said turning unit which couples said display unit arm and the one of said retaining units is made of a material having high thermal conductivity, and said display unit arm is made of a material having high thermal conductivity and high radiation performance.

A fourteenth aspect in accordance with the present invention provides a wearable display which is used while worn on a head, said wearable display supplying sound and video, the wearable display including: right and left ear pads which have a contact with head side surfaces; right and left retaining units which retain said ear pads, respectively, an electric circuit being incorporated in at least one of said retaining units; a head band unit which is coupled to said retaining units to impart a biasing force such that said ear pads are pressed against said right and left head side surfaces; a display unit arm which is coupled to one of said retaining units with a turning unit interposed therebetween; and a display unit which is coupled to a leading end portion of said display unit arm, wherein a top surface portion of said head band unit in wearing said wearable display is made of a material having high thermal conductivity and high radiation performance, and a heat transfer path is formed from the retaining unit in which the electric circuit is incorporated to said top surface portion of said head band unit in wearing said wearable display.

A fifteenth aspect in accordance with the present invention provides a wearable display which is used while worn on a head, said wearable display supplying sound and video, the wearable display including: right and left ear pads which have a contact with head side surfaces; right and left retaining units which retain said ear pads, respectively; a head band unit which couples said retaining units to impart a biasing force such that said ear pads are pressed against said right and left head side surfaces, an electric circuit being incorporated in said head band unit; a display unit arm which is coupled to one of said retaining units with a turning unit interposed therebetween; and a display unit which is coupled to a leading end portion of said display unit arm, wherein a top surface portion of said head band unit in wearing said wearable display is made of a material having high thermal conductivity and high radiation performance.

A sixteenth aspect in accordance with the present invention provides the wearable display of the fifteenth aspect, wherein a board on which said electric circuit is mounted and said top surface portion are jointed by a heat transfer path.

A seventeenth aspect in accordance with the present invention provides the wearable display in one of the fourteenth to sixteenth aspects, wherein a bottom surface portion of said head band unit in wearing said wearable display is made of a heat insulating material.

An eighteenth aspect in accordance with the present invention provides the wearable display in one of the thirteenth to sixteenth aspects, wherein a radiation fin or a radiation hole is provided in a radiation surface.

A nineteenth aspect in accordance with the present invention provides an output device which is used while worn on a head, said output device supplying at least one of sound and video, the output device including: right and left ear pads which have a contact with head side surfaces; right and left retaining units which retain said ear pads respectively, an electric circuit being incorporated in at least one of said retaining units; and a head band unit which couples said retaining units to impart a biasing force such that said ear pads are pressed against said right and left head side surfaces, wherein at least part of a region which has a contact with at least the head of a head side of a chassis of the one of said retaining units in which the electric circuit is incorporated is formed by a heat insulating member, and an opposite portion to said head side of said chassis constitutes a radiation surface.

A twentieth aspect in accordance with the present invention provides an output device which is used while worn on a head, said output device supplying at least one of sound and video, the output device including: right and left ear pads which have a contact with head side surfaces; right and left retaining units which retain said ear pads respectively, an electric circuit being incorporated in at least one of said retaining units; and a head band unit which couples said retaining units to impart a biasing force such that said ear pads are pressed against said right and left head side surfaces, wherein a heat insulating member is bonded to at least part of a region which has a contact with at least the head of a head side of a chassis of the one of said retaining units in which the electric circuit is incorporated, and an opposite portion to said head side of said chassis constitutes a radiation surface.

Effect of the Invention

Accordingly, the present invention can provide the output device in which the problem of the accommodation dimensions of the processing unit and the like and the problem of heat radiation are solved, and the wearable display in which the output device is used. The present invention can also provide the output device in which the dimensions of the retaining unit are restrained without generating the problem of the heat generation.

EXPLANATIONS OF LETTERS OR NUMERALS

Figure 1:
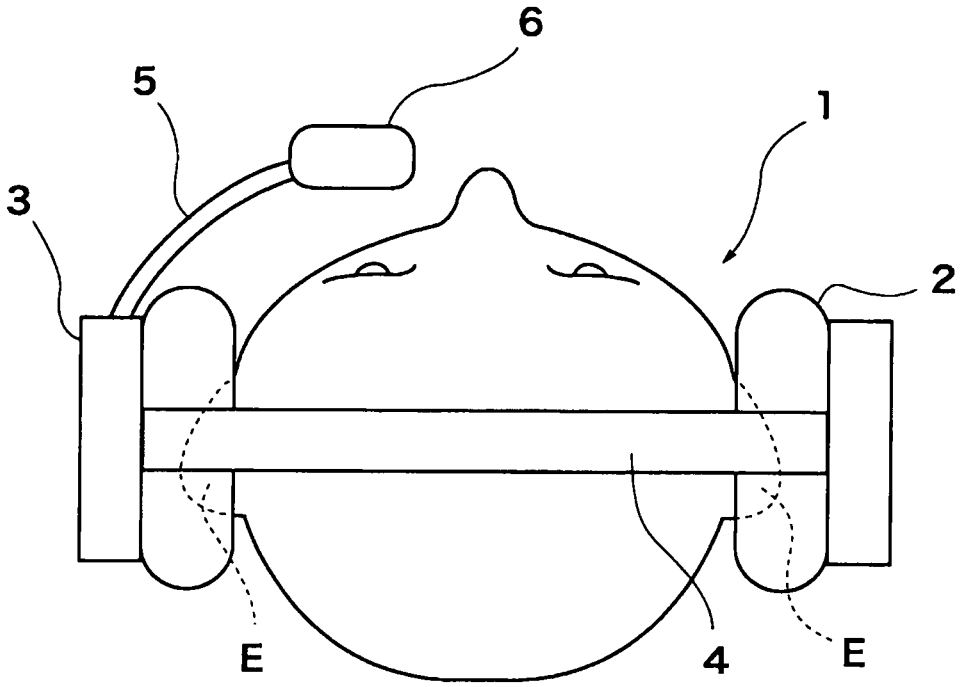
FIG. 1 is an overhead view schematically showing a state in which a wearable display according to a first embodiment of the present invention is mounted on a head.

1 wearable display
2 and 3 headphone
4 head band
5 support arm
6 display unit
31 pad
32 enclosure
33 dome
34 circuit support component
35 circuit board
41 speaker unit
42 and 43 retaining unit
44 and 45 joint unit
46 head band unit
47 and 48 headphone arm unit
49 display unit
50 display unit arm
51 first electric circuit
52 second electric circuit
61 and 62 ear pad
63 and 64 speaker
65 and 66 universal hinge
67 and 68 retaining unit
69 head band unit
70 display unit
71 display unit arm
72 turning unit
73 electric circuit
74 heat insulating member
81 and 82 ear pad
83 and 84 speaker
85 and 86 turning unit
87 and 88 retaining unit
89 head band unit
90 electric circuit
91 display unit
92 display unit arm
93 turning unit

BEST MODE FOR CARRYING OUT THE INVENTION

Exemplary embodiments of the present invention will be described below with reference to the drawings. FIG. 1 is an overhead view schematically showing a state in which a wearable display according to a first embodiment of the present invention is mounted on a head.

A wearable display 1 includes two headphones 2 and 3 and a head band 4. Auricles E of a user are covered with the headphones 2 and 3 which are of the fixing units. The head band 4 which is of the coupling unit couples the headphones 2 and 3. A support arm 5 is attached to the headphone 3, and a display unit 6 which displays video to the eye is attached to a leading end portion of the support arm 5.

Figure 2:
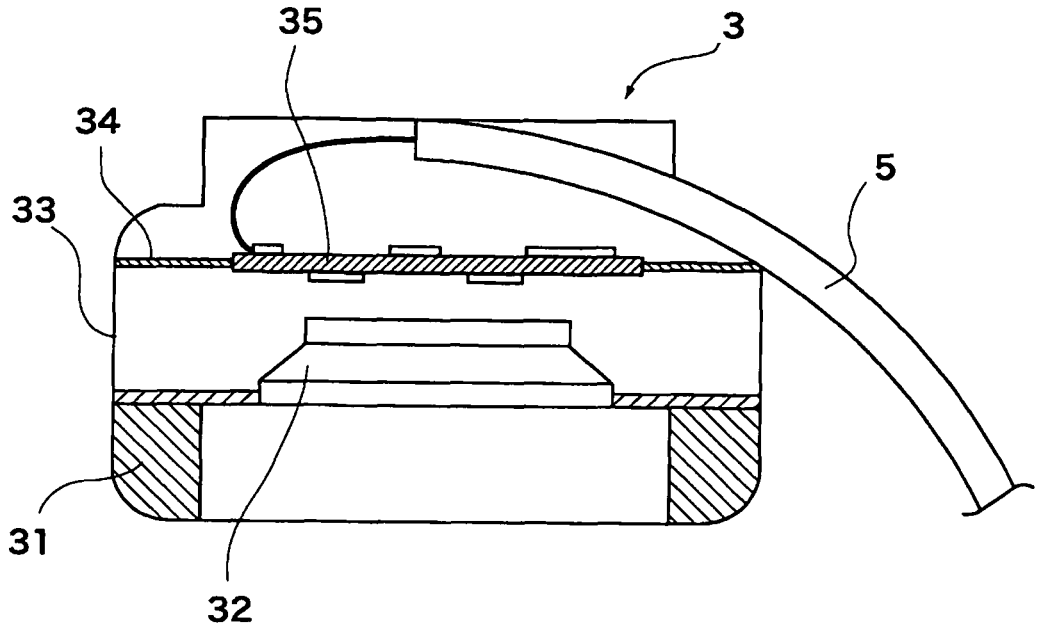
FIG. 2 is a view showing a detailed structure of a headphone.

FIG. 2 is a view showing a detailed structure of the headphone 3. The headphone 3 includes a pad 31, an enclosure 32, and a dome 33. The pad 31 has a contact with a head of a human body. The enclosure 32 supplies a sound. The dome 33 is of means for adjusting quality of audio output by resonating with or absorbing a sound wave emitted from the enclosure.

Because only components used to absorb and reflect sound is provided in the dome 33, a substantial hollow is formed in the dome 33. A circuit board 35 is provided in the dome 33 using a circuit support component 34, and the circuit support component 34 has a shape in which an air flow in the dome 33 is not blocked. The number of circuit boards 35 is not limited to one, and plural boards may be combined. Such a circuit board is also incorporated in the headphone 2.

The circuit boards 35 provided in the domes 33 of the headphones 2 and 3 are connected by a cable or FPC provided in the head band 4 to transmit a signal and an electric power.

At this point, a power supply connector may be mounted on the headphone (for example, headphone 2) on which a power supply circuit is mounted, and a terminal for communication with an external device may be mounted on the headphone 3 connected to the display unit 6, which allows an amount of wiring and a device volume to be further decreased. Desirably an input device such as SW used to perform input operation of the device should be provided in the headphone 2 which is not connected to the display unit 6. Alternatively, an interface circuit for feeding an operation signal and a connector can be provided in both the headphones 2 and 3, such that the operation unit can be connected to either of the headphones 2 and 3 according to usage (such as a dominant hand, a dominant eye, and a costume), which allows improved usability.

For example, a recording medium, a DSP circuit and a memory which decode moving image data, and a D/A circuit which produces an image display signal are mounted on the circuit board 35 of the headphone 3. A power supply and a voltage conversion circuit, a rechargeable battery, a CPU circuit which controls the power supply, and an A/D circuit which detects the state of the power supply are mounted in the dome of the headphone 2.

The DSP is used to decode moving image data which is compression-recorded in the recording medium. However, in the case of information having a high data compression ratio, the CPU in the headphone 2 is used to deal with part of computation processing, for example, decoding of audio information and to control a backlight light quantity, and, thereby dispersing a computation load.

The recording medium, the DSP circuit and memory which decodes the moving image data, and the D/A circuit which produces an image display signal are disposed in the circuit board 35 of the headphone 3 which is connected to the display unit 6 through the support arm 5, so that a signal line of an image signal to the display unit 6 can be shortened. Therefore, a noise of the image signal can optimally be reduced from the functional viewpoint. The power supply and voltage conversion circuit, the rechargeable battery, the CPU circuit which controls the power supply, and the A/D circuit which detects the state of the power supply are disposed in the dome of the headphone 2. Therefore, a weight balance between the headphone 3 and the headphone 2 can optimally be established from the functional viewpoint.

Thus, in the first embodiment, all the processing units and the like are not accommodated in one-side headphone, but the processing units and the like are divided into two groups, and each group is accommodated in either of the headphones. Therefore, dimensions of all the processing units and the like accommodated in one headphone can be reduced as a whole, and the processing units and the like are easily accommodated. Additionally, an amount of heat liberated by one headphone is decreased, and therefore heat can be easily radiated.

Figure 3:
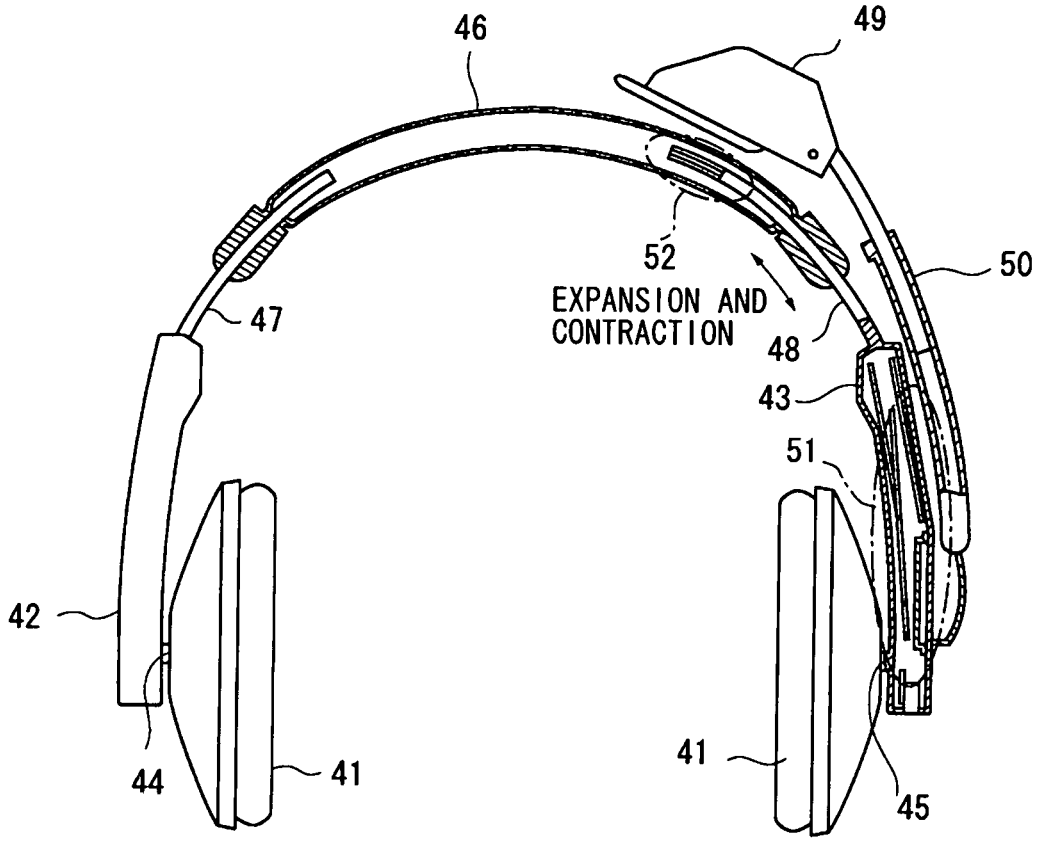
FIG. 3 is a view showing an outline of a wearable display according to a second embodiment of the invention.

FIG. 3 is a view showing an outline of a wearable display according to a second embodiment of the invention. The wearable display of the second embodiment is used while worn on the head, and the wearable display includes right and left speaker units 41 (fixing members) which have a contact with the head to fix the wearable display to the head. Speakers are incorporated in the speaker units 41, and the speakers supply sound to the respective ears.

The speaker units 41 are retained by retaining units 42 and 43 while joint units 44 and 45 are interposed therebetween, respectively. Therefore, turning and tilt angle of the speaker units 41 with respect to the retaining units 42 and 43 can be varied in some degree. The speaker units 41 (fixing members) and the retaining units 42 and 43 constitute the fixing units. The right and left retaining units 42 and 43 are connected to headphone arm units 47 and 48, respectively. The headphone arm units 47 and 48 are slidably coupled to a head band unit 46 while inserted into the head band unit 46. The head band unit 46 has an elastic force, and the head band unit 46 imparts such a biasing force that the head (ear portions) of the user is sandwiched between the right and left speaker units 41. The head band unit 46 and the headphone arm units 47 and 48 constitute the coupling unit.

A display unit 49 is turnably coupled to the right retaining unit 43 of FIG. 3 with a display unit arm 50 interposed therebetween. FIG. 3 shows the state in which the display unit 49 is orientated toward a head vertex portion. The display unit arm 50 can be turned from the state of FIG. 3 to locate the display unit 9 in front of the eye of the user, which allows the user to observe video displayed in the display unit 49.

Electric circuits accommodated in the wearable display are divided into a first electric circuit 51 and a second electric circuit 52. The first electric circuit 51 is accommodated in the retaining unit 43, and the second electric circuit 52 is attached to the leading end portion of the headphone arm unit 48. Thus, because the electric circuits are accommodated while divided into two, the dimensions of the retaining unit 43 which is used as the accommodation unit in the conventional technique are prevented from being enlarged, and radiation from the electric circuits is made separately in the two positions to restrain a temperature rise caused by the radiation in the accommodation unit and an attaching portion. A relative positional relationship is fixed because the separately provided electric circuits are attached to the retaining unit 3 and headphone arm unit 8 which are integrated with each other. Accordingly, the wiring connecting the electric circuits in the retaining unit 3 and headphone arm unit 8 is not expanded and contracted, and therefore the wiring can be easily routed.

As described above, the headphone arm units 47 and 48 are slidable with respect to the head band unit 46. When the position at which the second electric circuit 52 is attached is still located within the head band unit 46 even if the headphone arm unit 48 is pulled out from the head band unit 46 at a maximum, the second electric circuit 52 is not exposed. Accordingly, an appearance problem is not generated, and a problem caused by a possible contact between the electric circuit and an external object can be prevented from occurring.

Because the first electric circuit 51 includes a main signal processing unit, preferably an electric circuit which may become a noise generating source should be included in the second electric circuit 52 such that separated from the first electric circuit 51. That is, preferably the second electric circuit 52 should include the power supply circuit and the wireless communication circuit.

In the case where the second electric circuit 52 is a wireless communication circuit having an antenna, wireless communication cannot be conducted when the head band unit 46 is made of a material which interrupts a radio wave. Therefore, it is necessary that the head band unit 46 be made of a material which transmits the radio wave, or it is necessary that a portion made of a material which transmits the radio wave be provided in a portion in which the antenna is located. In the case where the position of the antenna is moved according to the sliding of the headphone arm unit 48, it is necessary that the portion made of a material which transmits the radio wave be provided in the range where the antenna is moved. From the functional viewpoint, the electric circuit 52 which is of the wireless communication circuit is optimally disposed in an upper portion of the wearable display, because sensitivity is improved in transmitting and receiving the radio wave.

Figure 4:
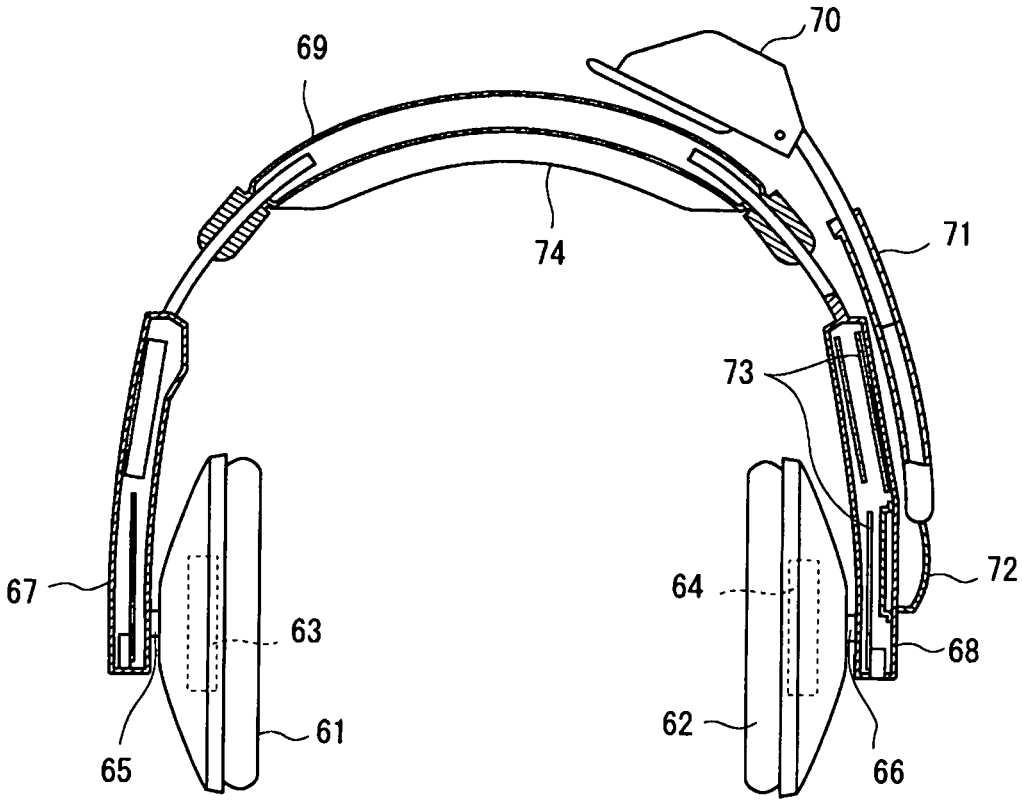
FIG. 4 is a view showing an outline of a wearable display according to a third embodiment of the invention.

FIG. 4 is a view showing an outline of a wearable display according to a third embodiment of the invention. The wearable display of the third embodiment includes ear pads 61 and 62 which press the ears from the right and left to fix the wearable display to the head. Speakers 63 and 64 are provided in the ear pads 61 and 62, and the speakers 63 and 64 supply sound to the ears, respectively. The ear pads 61 and 62 are fixed to retaining units 67 and 68 with universal hinges 65 and 66 interposed therebetween, respectively. The ear pads 61 and 62 and the retaining units 67 and 68 constitute the fixing units. The right and left retaining units 67 and 68 are sidably inserted in a head band unit 69 which is of the coupling unit, and the retaining units 67 and 68 are coupled by the head band unit 69. The head band unit 69 has elasticity, and the head band unit 69 imparts a biasing force to press the ear pads 61 and 62 against the ear portions from the right and left. Electric circuits 73 are attached to the inside of the chassis of the retaining unit 68.

A display unit 70 is retained by a display unit arm 71. The display unit arm 71 is joined to the retaining unit 68 with a turning unit 72 interposed therebetween, and the display unit arm 71 is turnable in a front-back direction in wearing the wearable display.

In the third embodiment, the turning unit 72 is made of a material having high thermal conductivity (about 10 W/m·K or more), and heat which is generated in the electric circuits 73 and transferred to the chassis of the retaining unit 8 is transferred to the display unit arm 71 for dissipation. The display unit arm 71 is made of a material having high thermal conductivity and high radiation performance (10 W/m·K or more), so that the heat transferred to the display unit arm 71 is radiated from surfaces of the display unit arm 71. A radiation fin or a radiation hole may be formed in the display unit arm 71. Any material such as a metal material and a thermal conductive resin can be selected and used as a material for the turning unit and the display unit arm as long as the material has a thermal conductivity of 10 W/m·K or more.

A top side of the head band unit 9 in wearing the wearable display is made of a material having high thermal conductivity and good radiation performance. A sliding portion of the retaining unit 68 is also made of a material having high thermal conductivity. Heat which is generated in the electric circuits 73 and transferred to the chassis of the retaining unit 68 is transferred to the head band unit 69 through the sliding portion of the retaining unit 68, and the heat is radiated from the top side of the head band unit 69 in wearing the wearable display. In wearing the wearable display, the top side of the head band unit 69 is orientated upward and kept horizontal. Accordingly, the top side of the head band unit 69 particularly has a large radiation effect. A radiation fin or a radiation hole may be provided in the radiation surface.

Figure 5:
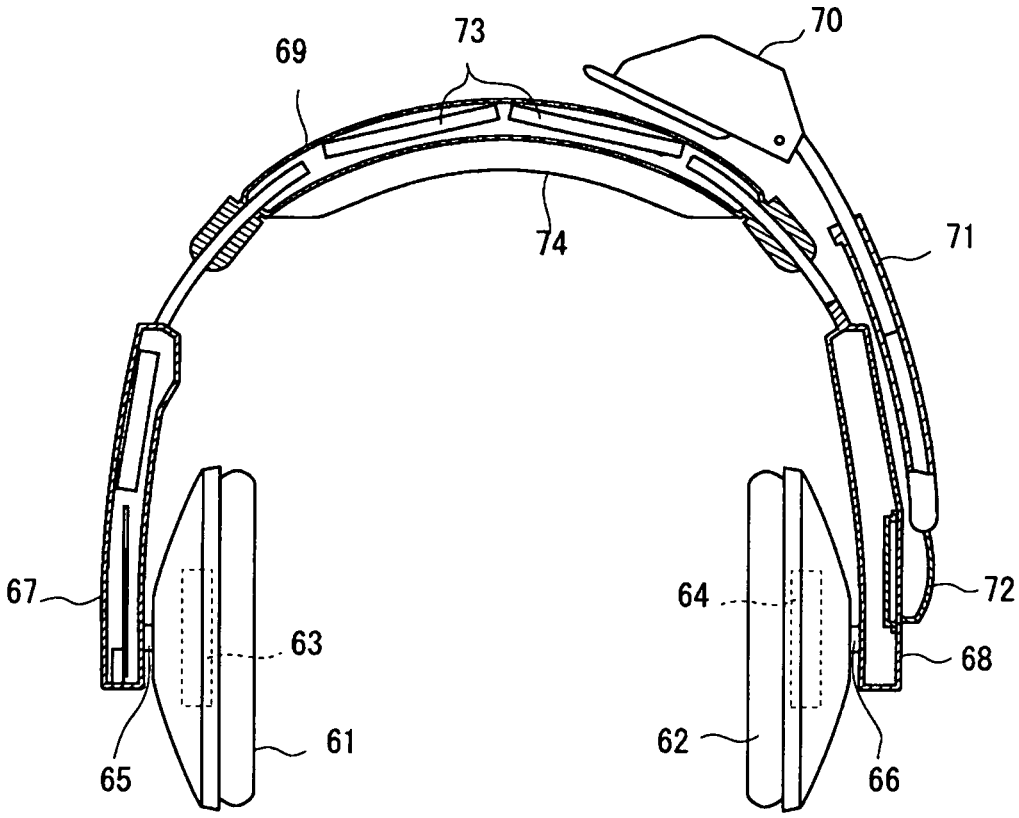
FIG. 5 is a view showing an outline of a wearable display according to a fourth embodiment of the invention.

FIG. 5 is a view showing an outline of a wearable display according to a fourth embodiment of the invention. In FIG. 5, the same component as that in the third embodiment of FIG. 4 is designated by the same numeral, and sometimes the description will be omitted. In the fourth embodiment, electric circuits 73 are accommodated in the head band unit 69. The top side of the head band unit 69 in wearing the wearable display is made of a material having high thermal conductivity and good radiation performance. Therefore, heat generated in the electric circuits 73 is radiated from the top side of the head band unit 69 in wearing the wearable display. At this point, the radiation effect can be enhanced, when the board on which the electric circuits 73 are mounted and the radiation surface of the chassis unit of the head band unit 69 are coupled by a heat transfer member. As described above, in wearing the wearable display, the top side of the head band unit 69 is orientated upward and kept horizontal, and therefore the top side of the head band unit 69 particularly has a large radiation effect. A radiation fin or a radiation hole may be provided in the radiation surface.

In the third embodiment shown in FIG. 4 and the fourth embodiment shown in FIG. 5, when the heat is transferred to the head band unit 69, the chassis of the head band unit 69 is heated, and sometimes the user has an uncomfortable feeling. Therefore, preferably a head side (bottom side in wearing the wearable display) of the head band unit 69 should be formed by a heat insulating member 74 such as rubber or a resin.

Figure 6:
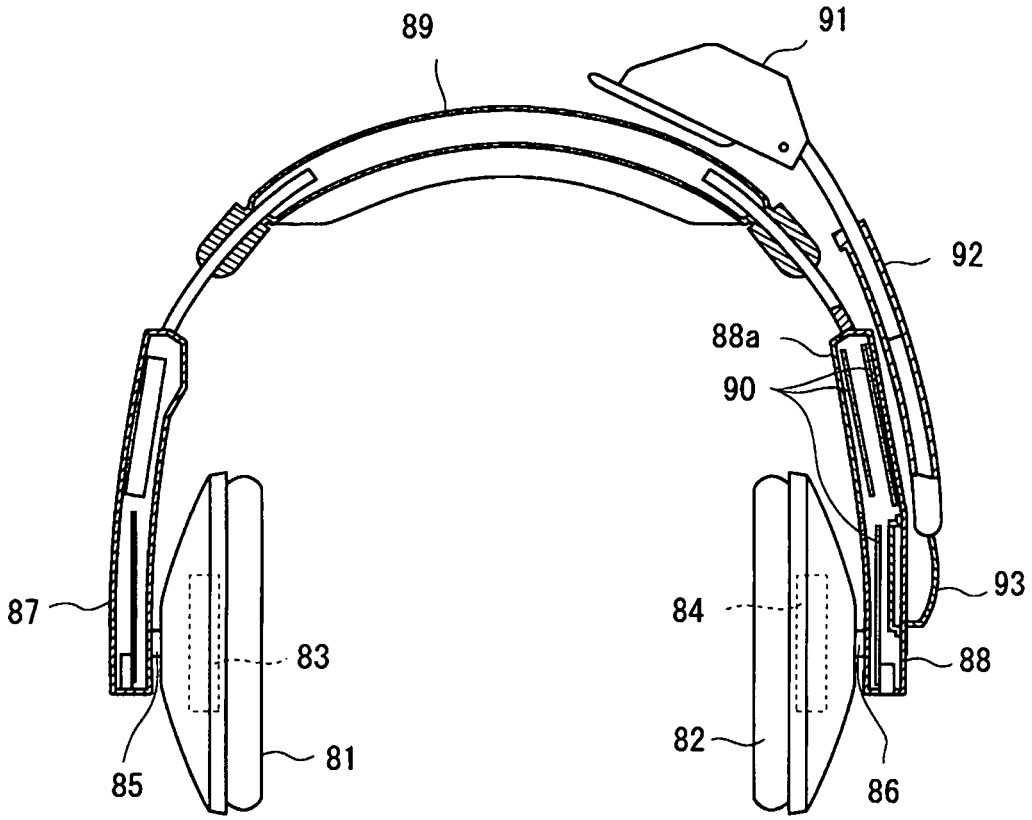
FIG. 6 is a view showing an outline of a wearable display according to a fifth embodiment of the invention.

FIG. 6 is a view showing an outline of a wearable display according to a fifth embodiment of the invention. The wearable display of the fifth embodiment includes ear pads 81 and 82 which press the ears from the right and left to fix the wearable display to the head. Speakers 83 and 84 are provided in the ear pads 81 and 82, and the speakers 83 and 84 supply sound to the ears, respectively. The ear pads 81 and 82 are fixed to retaining units 87 and 88 with turning units 85 and 86 interposed therebetween, respectively. The ear pads 81 and 82 and the retaining units 87 and 88 constitute the fixing units. The right and left retaining units 87 and 88 are slidably inserted in a head band unit 89 which is of the coupling unit, and the retaining units 87 and 88 are coupled by the head band unit 89. The head band unit 89 has elasticity, and the head band unit 89 imparts a biasing force to press the ear pads 81 and 82 against the ear portions from the right and left.

Electric circuits 90 are attached to the inside of the chassis of the retaining unit 88. A portion 88*a* which is located on the head side of the chassis of the retaining unit 88 and may have a contact with the head is formed by a heat insulating member, and the opposite side to the head side constitutes the radiation surface. Therefore, heat is not transferred to the portion in which the retaining unit 88 has a contact with the head, and heat generated from the electric circuits 90 is emitted from the radiation surface located on the opposite portion to the head side.

The whole of the chassis head side of the retaining unit 88 may be formed by a heat insulating member. It is not always necessary that the whole in a thickness direction of the chassis be formed by the heat insulating member, but a part in the thickness direction may be formed by the heat insulating member.

The heat insulating member may be bonded to at least part of a region of the head side of the chassis of the retaining unit 88 which may have a contact with at least the head, and an opposite portion to the head side may constitute a radiation surface. In this case, the heat insulating member may be bonded to at least one of the inside and the outside of the portion which forms the head side of the chassis.

In FIG. 6, a display unit is designated by numeral 91, and the display unit is joined to a display unit arm 92. The display unit arm 92 is joined to the retaining unit 88 by a turning unit 93 so as to be turnable in the front-back direction in wearing the wearable display. However, the configurations of the display unit arm 92 and turning unit 93 do not relate to the present invention, so that the description is omitted.

The thermal conductive mechanism, radiation mechanism, and heat insulating mechanism of the wearable display of the third to fifth embodiments may be applied to the wearable display of the first embodiment and the wearable display of the second embodiment. As a result, a radiation efficiency of heat generated in the wearable display of the first embodiment and the wearable display of the second embodiment can be enhanced, and heat transferred from the wearable display to the head can be reduced.

The invention claimed is:

1. A wearable display which is used while worn on a head, said wearable display supplying sound and video, the wearable display comprising:

right and left ear pads which have a contact with head side surfaces;

right and left retaining units which retain said ear pads, respectively;

a head band unit which is coupled to said retaining units to impart a biasing force such that said ear pads are pressed against said right and left head side surfaces;

a display unit arm which is coupled to one of said retaining units with a turning unit interposed therebetween;

a display unit which is coupled to a leading end portion of said display unit arm, an electric circuit being incorporated in the one of said retaining units coupled to said display unit arm, wherein said turning unit which couples said display unit arm and the one of said retaining units is made of a material having high thermal conductivity, and said display unit arm is made of a material having high thermal conductivity and high radiation performance; and heat generated in the electric circuit is radiated from the surfaces of said display unit arm, and a material having a thermal conductivity of 10 W/m·K or more is used for said turning unit which couples said display unit arm and the one of said retaining units and said display unit arm.

2. The wearable display as in claim 1, wherein a radiation fin or a radiation hole is provided in a radiation surface.

3. A wearable display which is used while worn on a head, said wearable display supplying sound and video, the wearable display comprising:

right and left ear pads which have a contact with head side surfaces;

right and left retaining units which retain said ear pads, respectively, an electric circuit being incorporated in at least one of said retaining units;

a head band unit which is coupled to said retaining units to impart a biasing force such that said ear pads are pressed against said right and left head side surfaces;

a display unit arm which is coupled to one of said retaining units with a turning unit interposed therebetween;

a display unit which is coupled to a leading end portion of said display unit arm, wherein a top surface portion of said head band unit in wearing said wearable display is made of a material having high thermal conductivity and high radiation performance, and a heat transfer path is formed from the retaining unit in which the electric circuit is incorporated to said top surface portion of said head band unit in wearing said wearable display;

heat generated in the electric circuit is radiated from said top surface portion of said head band unit in wearing said wearable display, and a material having a thermal conductivity of 10 W/m·K or more is used for said top surface portion of said head band unit in wearing said wearable display.

4. A wearable display which is used while worn on a head, said wearable display supplying sound and video, the wearable display comprising:

right and left ear pads which have a contact with head side surfaces;

right and left retaining units which retain said ear pads, respectively;

a head band unit which couples said retaining units to impart a biasing force such that said ear pads are pressed against said right and left head side surfaces, an electric circuit being incorporated in said head band unit;

a display unit arm which is coupled to one of said retaining units with a turning unit interposed therebetween;

a display unit which is coupled to a leading end portion of said display unit arm, wherein a top surface portion of said head band unit in wearing said wearable display is made of a material having high thermal conductivity and high radiation performance;

heat generated in the electric circuit is radiated from said top surface portion of said head band unit in wearing said wearable display; and a material having a thermal conductivity of 10 W/m·K or more is used for said top surface portion of said head band unit in wearing said wearable display.

5. The wearable display according to claim 4, wherein a board on which said electric circuit is mounted and said top surface portion are jointed by a heat transfer path.

6. The wearable display according to claim 3, wherein a bottom surface portion of said head band unit in wearing said wearable display is made of a heat insulating material.

7. An output device which is used while worn on a head, said output device supplying at least one of sound and video, the output device comprising:

right and left ear pads which have a contact with head side surfaces;

right and left retaining units which retain said ear pads respectively, an electric circuit being incorporated in at least one of said retaining units;

a head band unit which couples said retaining units to impart a biasing force such that said ear pads are pressed against said right and left head side surfaces, wherein at least part of a region which has a contact with at least the head of a head side of a chassis of the one of said retaining units in which the electric circuit is incorporated is formed by a heat insulating member, and an opposite portion to said head side of said chassis constitutes a radiation surface;

heat generated in the electric circuit is radiated from the radiation surface located on the opposite portion to said head side of said chassis; and a material having a thermal conductivity of 10 W/m·K or more is used for the radiation surface located on the opposite portion to said head side of said chassis.

8. An output device which is used while worn on a head, said output device supplying at least one of sound and video, the output device comprising:

right and left ear pads which have a contact with head side surfaces;

right and left retaining units which retain said ear pads respectively, an electric circuit being incorporated in at least one of said retaining units;

a head band unit which couples said retaining units to impart a biasing force such that said ear pads are pressed against said right and left head side surfaces, wherein a heat insulating member is bonded to at least part of a region which has a contact with at least the head of a head side of a chassis of the one of said retaining units in which the electric circuit is incorporated, and an opposite portion to said head side of said chassis constitutes a radiation surface;

heat generated in the electric circuit is radiated from the radiation surface located on the opposite portion to said head side of said chassis; and a material having a thermal conductivity of 10 W/m·K or more is used for the radiation surface located on the opposite portion to said head side of said chassis.

* * * * *